United States Patent [19]

Schramm

[11] 4,425,597

[45] Jan. 10, 1984

[54] ELECTRONIC LOCKING METHOD AND APPARATUS

[76] Inventor: Wayne E. Schramm, 8427 Frost Way, Annandale, Va. 22003

[21] Appl. No.: 348,754

[22] Filed: Feb. 16, 1982

[51] Int. Cl.[3] ..... E05B 49/00

[52] U.S. Cl. ..... 361/172; 307/10 AT

[58] Field of Search ..... 361/171, 172; 307/10 AT; 340/63, 542, 543; 200/61.62, 61.64

[56] References Cited

U.S. PATENT DOCUMENTS

| | | | |
|---|---|---|---|
| 1,708,138 | 7/1927 | Hildahl . | |
| 2,459,029 | 4/1946 | Ingres et al. . | |
| 3,214,214 | 10/1965 | Marchant . | |
| 3,235,300 | 2/1966 | McRae et al. . | |
| 3,265,927 | 9/1966 | Massoll . | |
| 3,660,729 | 5/1972 | James et al. . | |
| 3,710,316 | 1/1973 | Kromer . | |
| 3,715,536 | 2/1973 | Husch et al. . | |
| 3,740,573 | 6/1973 | Kellermeyer . | |
| 3,751,718 | 8/1973 | Hanchett, Jr. . | |
| 3,812,403 | 5/1974 | Gartner | 361/172 |
| 3,908,149 | 9/1975 | Gergoe et al. . | |
| 4,019,355 | 4/1977 | Germanton | 361/172 X |
| 4,093,870 | 6/1978 | Epstein . | |

*Primary Examiner*—Harry E. Moose, Jr.

*Attorney, Agent, or Firm*—Kerkam, Stowell, Kondracki & Clarke

[57] ABSTRACT

An electronic combination lock uses a single pair of contacts which are connected to a door opening actuator such that a code may be input into the electronic combination lock by sequentially moving the door opening actuator in a predetermined pattern. The device is especially suitable for use in car doors such that the appearance of a conventional car door is maintained, but the ease of entry with an electronic combination lock is provided. A detecting circuit detects whether the car door pushbutton or movable handle is moved in the correct timed sequence. The initial movement of the pushbutton or door handle is used for starting a timer running and initiating the supply of power to the detecting circuit. A pulse generator outputs a series of pulses which are fed into a pulse sequencer. The pulse sequencer is used for gating the switch position (open or closed) to one of a number of parallel disposed registers in a latching circuit. A code selector and decoder are used to determine whether the latched code is equivalent to the preprogrammed code. A lock sensing switch is used in the system to minimize power consumption.

26 Claims, 9 Drawing Figures

ELECTRONIC LOCKING METHOD AND APPARATUS

BACKGROUND OF THE INVENTION

The present invention relates to locking systems, and, more particularly, to electronic locking systems which are actuated by inputting a correct code.

The use of electronic combination locks is well known. More specifically, such combination locks usually employ a plurality of switches which, when set to correspond to a predetermined code, are used to actuate a solenoid or similar device to unlock a door. Alternately, the electronic combination lock may be triggered by opening and closing a single switch in a timed predetermined sequence.

The following patents relate to this general area:

| Patent No. | Issue Date |
|---|---|
| 3,660,729 - James et al | May 2, 1972 |
| 3,710,316 - Kromer | Jan. 9, 1973 |
| 3,751,718 - Hanchett, Jr. | Aug. 7, 1973 |
| 4,093,870 - Epstein | June 6, 1978 |

The James et al patent discloses an electronic combination lock for unlocking a locking bar used on an enclosure. The system includes a decoder having a built-in combination based on correct number, sequence, and spacing of digits input into the circuit.

The Kromer patent discloses a vehicle electrical combination lock including a series of switches which are used to input a sequential code.

The Hanchett patent discloses an electronic car door unlocking circuit including a single pair of electrical contacts which are sequentially operated to input a code. A cycle counter, display, memory register, code select switches and gates are used in the circuit. A timing light is used such that the person operating the lock switch may be aware of the timing intervals. The contacts may be those of a push button switch located below the car door handle.

The Epstein patent discloses circuitry for use as either a reflex tester or a combination lock wherein a single switch is used for turning on the circuitry and for inputting coded signals. A light is used to indicate the timing intervals to the person using the apparatus.

Although the above and other prior art devices have been somewhat useful in providing electronic combination locks, they have usually been subject to one or more of several disadvantages.

One of these disadvantages is that such prior art devices are usually visible to a potential intruder. That is, someone approaching a door protected by such combination locks will usually see the switch or switches and thereby deduce the existence of the electronic combination lock. This may aid the intruder in attempting to neutralize or overcome the electronic lock.

A further disadvantage of many of these prior art devices is that they require the drilling of holes or otherwise time consuming modifications to the pre-existing enclosure in order to mount the electronic combination lock.

Yet another disadvantage common to the prior art is that such devices unnecessarily use power when no one is operating them. That is, their quiescent power consumption is higher than necessary. Further, such electronic combination circuits function even when the door is unlocked. This results in an even greater waste of energy.

OBJECTS

Accordingly, it is a primary object of the invention to provide a new and improved electronic locking system and associated method.

A further object of the present invention is to provide an electronic combination locking system and method wherein the existence of the locking system will not be apparent to those who view the door.

A further object of the present invention is to provide an electronic combination locking system wherein the electronic locking system may be installed with a minimum of modification to pre-existing door structures.

A still further object of the present invention is to provide an electronic combination locking system and method wherein power is conserved by turning off power to most of the circuits until, and, unless someone starts to operate the electronic locking system.

Another object of the present invention is to conserve energy by providing an electronic combination locking system and method wherein power is removed from most of the systems circuits when the door is unlocked.

Another object of the present invention is to provide a new and improved locking system and method especially suitable for use on car doors.

SUMMARY OF THE INVENTION

These and other objects of the present invention which will become more apparent as the description proceeds are realized by a method of unlocking a door including the steps of operating a door opening actuator in a predetermined sequence, detecting the predetermined sequence, generating an electrical unlock signal upon detection of the predetermined sequence, and unlocking the door responsive to the electrical unlock signal. The predetermined sequence of door opening actuator operation causes a corresponding predetermined sequence of switch opening/closing operations and the detecting step comprises detecting the predetermined sequence of door opening actuator operations by detecting the predetermined sequence of switch opening/closing operations. The predetermined sequence of switch opening/closing operations is a timed predetermined sequence of openings and closings of a first switch. Preferably, the door is a car door and the door opening actuator is a door handle, the movement of at least a portion of which will cause the first switch to open and/or close.

The apparatus of the present invention is realized by a door having a manually operable door opening actuator and a door lock controlled by a door lock actuator, a detecting circuit for detecting a predetermined sequence of operations of the door opening actuator and for generating an unlock signal, and an unlocking circuit for unlocking the door responsive to the unlock signal. The switch is opened or closed depending upon the door opening actuator and the detecting circuit detects the predetermined sequence of operations of the door opening actuator by detecting a timed predetermined sequence of openings and closings of the switch. Preferably, the door is a car door and the door opening actuator is a door handle. The normal opening movement of at least a portion of the door handle is used for opening and/or closing the switch. Preferably, the switch is a mechanical switch with at least two contacts which are opened and closed depending upon the position of the door handle. The detecting circuit preferably comprises a pulse generator for generating a series of pulses, a determinator circuit for repetitively determining whether the switch is opened or closed, each determination corresponding to a pulse in the series of pulses, a latch of storing the results of a plurality of the determinations, a code selector for selecting the timed predetermined sequence of openings and closings of the switch, and a testing circuit for testing for equality between the timed predetermined sequence selected by the code selector and the actual sequences of openings and closings of the switch. A power down circuit for turning off power to the detecting circuit after generation of the unlock signal and a power up circuit for turning on power to the detecting circuit upon an initial operation on the door opening actuator are used for conserving power. Additionally, a lock sensing switch is used to ensure that power is not delivered to the detecting circuit if the lock sensing switch senses that the door is unlocked.

BRIEF DESCRIPTION OF THE DRAWINGS

Additional features and advantages of the present invention will be made more apparent as the description proceeds by reference to the accompanying drawings wherein like reference characters represent like parts throughout.

DETAILED DESCRIPTION OF THE PREFERRED EMBODIMENTS

Electrical Circuitry

Figure 1:
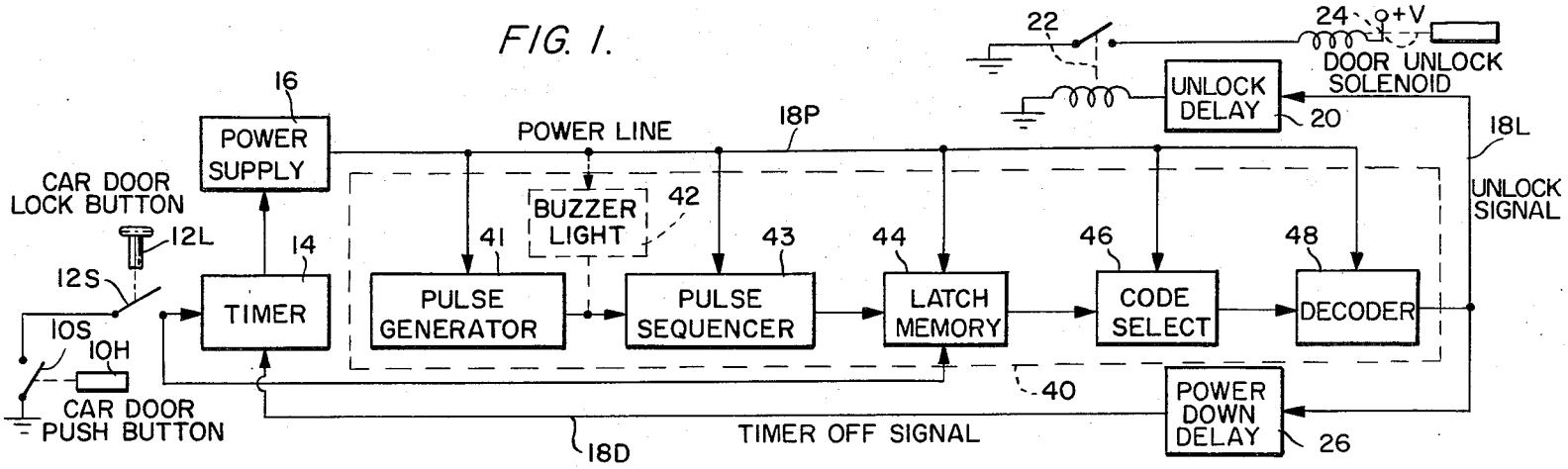
FIG. 1 shows in block diagram form an electrical locking apparatus according to the present invention.

Turning initially to FIG. 1, there is shown a preferred embodiment of the electronic apparatus of the present invention. Most of the circuitry is shown in block diagram form with several mechanical parts shown schematically.

A switch 10S which is opened and closed by way of a door opening actuator such as car door push button 10H is used to input signals to timer 14 and latch memory 44 of detecting circuit 40 by way of code line 18C. Most advantageously, door lock sensing switch 12S is in series with code input switch 10S such that switch 10S will not send signals to timer 14 and latch memory 44 unless door lock sensing switch 12S is closed. Door lock sensing switch 12S will be closed only when the door is locked as when the car door lock button is depressed. The initial closure of code input switch 10S will cause timer 14 to begin timing and to turn on power supply 16 by way of line 18U. Power supply 16 will provide power for the numerous circuits within detecting circuit 40 by way of power line 18P.

Following the initial closure of switch 10S and the subsequent powering up of the detecting circuit 40, the pulse generator 41 will output a series of pulses to the pulse sequencer 33. Additionally, if desired a sensory signal generator such as a buzzer or light 42 may be connected to the output of pulse generator 41. The sensory signal generator 42 would simply output a repetitive signal capable of being sensed by a human being. The pulse sequencer 43, which may be realized by a bucket brigade pulse stepper, simply steps through a number of lines connecting it to a latch memory 44, thereby selecting a single flip-flop or cell within latch memory 44 for storing the input code line 18C from switch 10S during that particular pulse.

The output from the latch memory 44 is a parallel output representative of the state of code input switch 10S during particular time intervals. This output is input in parallel to a code select circuit 46 which is used for selecting a particular code for unlocking the lock. The output of the code select circuit is decoded in decoder 48, thereby determining if the actual sequence of openings and closings of code input switch 10S correspond to the preset code corresponding to the predetermined sequence of openings and closings necessary to unlock the lock. If the code which is preset in the code selector 46 is the same as the actual sequence input by way of code input switch 10S, the decoder 48 will output an unlock signal on line 18L.

The unlock signal on line 18L is input into an unlock delay 20, the purpose of which is explained in full below. Following the delay in the unlock delay circuit 20, the unlock relay 22 is closed, thereby in turn causing the operation and unlocking of door unlock solenoid 24.

The unlock signal on line 18L is also input into a power down delay circuit which outputs a timer off signal on line 18D following a delay. The timer off signal on line 18D will reset timer 14, which in turn causes power supply 16 to shut off power to the various circuits within detecting circuit 40.

Figure 2:
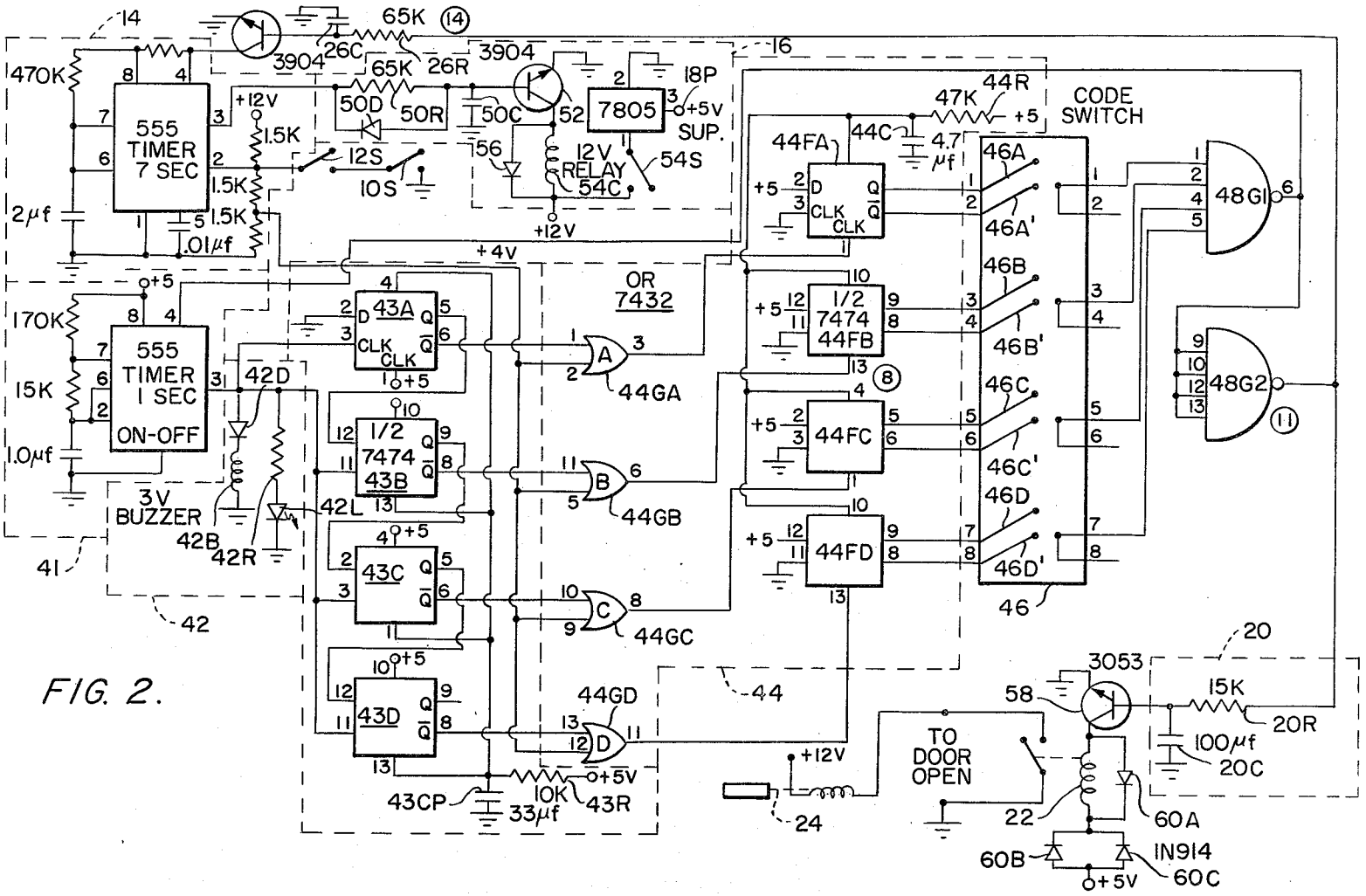
FIG. 2 shows specific circuitry which may be used to realize the block diagram of FIG. 1.

Turning now to FIG. 2 but also continuing to consider the block diagram of FIG. 1, specific components which may be used to realize the embodiment of FIG. 1 will be discussed. As shown in FIG. 2, code input switch 10S and lock sensing switch 12S are attached in series to an input of timer 14 which as shown comprises a 555 timer with associated resistors and capacitors to realize a one shot or monostable multivibrator. Although resistive and capacitive values are given in the drawing, these could be varied with considerable range. Moreover, the functioning of these various resistors and capacitors need not be discussed in detail inasmuch as those of ordinary skill in the art will readily realize the implementation of a monostable multivibrator with a 555 type timer. Preferably, the 555 timer used in the timer 14 of the present invention is set to provide a seven second output pulse at its terminal 3 corresponding to line 18U. This seven second pulse on line 18U is fed to power supply 16 which includes a delay circuit comprising resistor 50R, capacitor 50C, and diode 50D, the function of which will be discussed in the operation section below. A transistor 52 is connected in series with a realy coil 54C between ground and a 12 volt supply (not shown), which may simply be the car battery. A diode 56 is connected as shown. The 12 volts are provided to terminal 1 of power regualtor chip 7805 when contacts 54S controlled by relay coil 54C are closed. Chip 7805 in turn provides a regulated 5 volt supply on its terminal 3, which may be connected to the various nodes labelled +5 volts in the components of the detecting circuit. For simplicity, power output line 18P corresponding to terminal 3 of chip 7805 is not shown connected to the various +5 volt nodes.

In addition to initiating an output pulse from the seven second 555 timer of timer 14, the code input switch 10S may be used to input a timed predetermined sequence of openings and closings on line 18C. Specifically, line 18C would normally be disposed at about +4 volts because of the three 1.5k voltage divider resistors. When switch 10S is closed the voltage on line 18C would be approximately 0. This voltage on line 18C is fed into latch memory 44.

Once the regulated 5 volts is supplied to pulse generator 41, the pulse generator 41 outputs a series of pulses. Specifically, the pulse generator 41 may be realize by a type 555 timer arranged as an astable multivibrator in the configuration shown. This configuration is well known to those in the art and the various resistors and capacitors attached to the 555 timer need not be discussed in detail. Preferably, the capacitive and resistive values are such that the output at terminal 3 of the 555 timer will be 0.9 second pulses separated by 0.1 second intervals.

The optional sensory signal output generator 42 may be realized by a buzzer 42B connected in series with a diose 42D and/or resistor 42R connected in series with a light emitting diode 42L. The sensory signal output generator 42 outputs a signal for human perception corresponding to the time intervals on the pulses at terminal 3 of the 555 timer.

The pulses out of the astable 555 timer of pulse generator 41 are also fed into a pulse sequencer 43. The pulse sequencer 43 includes flip-flops or registers 43A, 43B, 43C and 43D, each of which may be one-half of a 7474 chip. Resistor 43R and capacitor 43CP are used as a power up setting circuit to set register 43A at Q=1 and the remaining registers 43B, 43C and 43D at Q=0. The not-Q outputs of the registers 43A, 43B, 43C and 43D are respectively input into one of the inputs of OR gates 44GA, 44GB, 44GC and 44GD of the latch memory circuit 44. The gates 44GA, 44GB, 44GC and 44GD operate to demultiplex the signal on line 18C in four equal time intervals defined by the pulsing of pulse generator 41. The outputs of the gates 44GA, 44GB, 44GC and 44GD are respectively input into the flip-flops or registers 44FA, 44FB, 44FC and 44FD. These registers are used as a latching memory to remember whether the code input switch 10S was depressed during respective first, second, third and fourth time intervals. Since the state of switch 10S is controlled by the position of the door actuator 10H (or 90H), the code entered into memory 44 is uniquely and completely determined by operation of the door actuator 10H (or 90H). It is uniquely determined in that there is only one code entered for a given sequence of operations of the actuator. In other words, repeating the same sequence will always enter the code. The code is completely determined by the actuator 10H since the code which is entered does not depend on manipulation of anything other than the actuator 10K. The registers 44FA, 44FB, 44FC and 44FD, which are initially zeroed by power up resistor 44R and power up capacitor 44C, may be each realized by one half of a 7474 chip. The outputs of the registers of latch 44 are fed into a code selector 46 which includes switches 46A, 46A', 46B, 46B', 46C, 46C', 46D and 46D'. The code selector 46 may be realized by eight rocker switches on a minidip switch. Such a minidip (dual in line package) switch is especially suitable for the code selector because it may be easily reset with a ball point pen. Depending upon the settings on the code selector 416, the Q or not-Q outputs of the latch memory are fed out of code selector 46 into the decoder 48. Specifically, the four inputs to NAND gate 48G1 are fed by the code selector 46. The output of NAND gate 48G1 may be connected to the terminal 4 to turn off the astable multivibrator 555 timer of the pulse generator. The output of the gate 48G1 is also input to a NAND gate 48G2 which simply serves an an inverter. The output of gate 48G2 is an unlock signal which is fed into unlock delay 20 comprising resistor 20R and capacitor 20C. The output of the unlock delay circuit 20 switches transistor 58 from conducting to nonconducting modes. Transistor 58 is in series with the relay coil of relay 22 and diodes 60B and 60C. Diode 60A is attached in parallel to the relay coil of relay 22. Relay 22 is the door unlock relay which controls the door lock solenoid 24.

The unlock signal fed on line 18L out of gate 48G2 is also input into power down delay circuit 26 comprising resistor 26R and capacitor 26C. The output of power down delay circuit if fed into the reset terminal 4 of the monostable multivibrator 555 timer circuit 14 by way of transistor 62.

Mechanical Placement of the Switches

Figure 3:
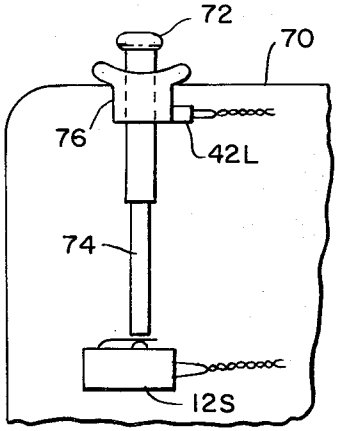
FIG. 3 shows a portion of a car door and a light source and car door lock sensing switch according to the present invention.

Turning now to FIG. 3, there is shown a broken away view of a car door 70 illustrating how the lock sensing switch 12S may be mounted. In particular, lock button 72 and associated lock push rod 74 are illustrative of a type of car door lock commonly used. For simplicity's sake, the drawing omits various mechanisms such as a mechanism which would be connected to push rod 74 and when actuated by pushrod 74 would lock the door. These structures are quite conventional and need not be discussed in detail. As shown, the push rod 74 may be used to actuate the present lock sensing switch 12S. Locking the door 70 by depressing the lock button 72 will cause push rod 74 to cause the closing of switch 12S, which may for example be a microswitch. Switch 12S may be mounted in a number of different ways inside the door as, for example, a bracket (not shown) which extends out from door panel 70. The door 70 would include an inner panel which has been removed for ease of viewing in FIG. 3.

FIG. 3 serves to illustrate a mounting for the light 42L, which may for example by an LED. In particular, light 42L is attached to, or secured adjacent, a clear plastic grommet 76 which is used at the outside diameter at the hole which houses lock button 72. As with the switch 12S, push rod 74, and the lower end of lock button 72, the light 42L would be disposed inside of the door 70 and would not normally be easily visible except when turned on.

Figure 4:
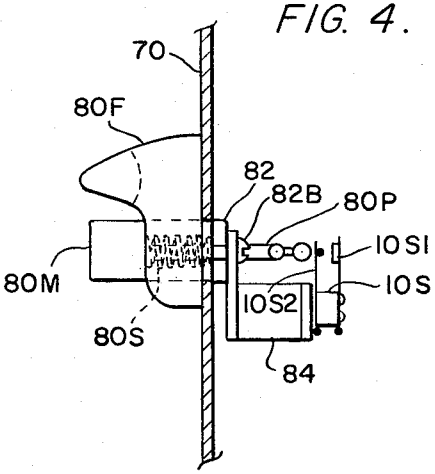
FIGS. 4, 5 and 6 respectively show side, top, and back views of an embodiment of a code inputting switch according to the present invention in a conventional push button car door handle.
Figure 5:
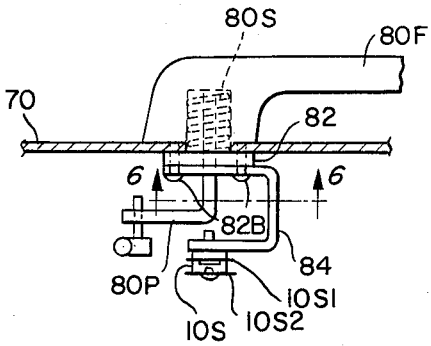
Figure 6:
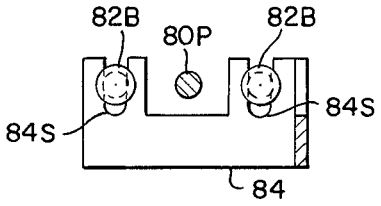

Turning now to FIGS. 4, 5 and 6, the mounting of a code input switch 10S in a push button door handle will be discussed. FIG. 4 shows a side view in cross section of a car door 70 with its inside panel removed for simplicity. FIG. 5 shows a top view in partial cross section of the outside wall of car door 70 and various mechanisms used to open the car door. FIG. 6 shows a cross-section back view (i.e., from inside the car) taken along lines 6—6 of FIG. 5.

The basic mechanical structure shown in FIGS. 4, 5 and 6 will be readily recognized as a conventional push button type of car door opener. In particular, the car door handle includes a fixed gripping part 80F and a movable pushbutton part 80M. A spring 80S biases the push button 80M outwardly. Attached to the push button 80M is a push rod 80P for movement therewith. The push rod 80P would extend to a door opening mechanism (not shown) commonly used in the art. Further, a plate 82 is used with bolts which hold the fixed handle portion 80F to the car door outside panel 70.

In order to adapt the conventional pushbutton type of car door handle to work with the present invention, the bolts 82B are simply loosened and a contact bracket holder 84 is attached to the plate 82 by the bolts 82B. If desired, the contact bracket holder 84 may simply include two vertically extending slots 84S as best shown in the cross section of FIG. 6. As shown, the switch 10S may include two contact arms 10S1 and 10S2 which are brought in contact when the push rod is displaced inwardly by depression of the push button 80M.

Figure 7:
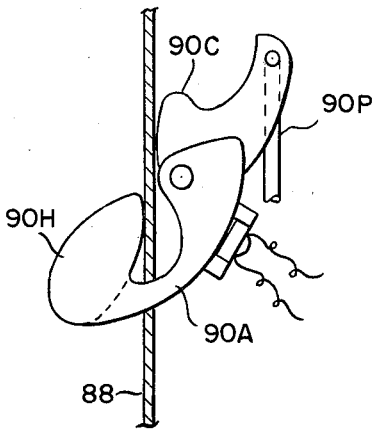
FIGS. 7, 8 and 9 respectively show side, back and top views of an embodiment of a code input switch according to the present invention in combination with a conventional pull-up type car door handle.
Figure 8:
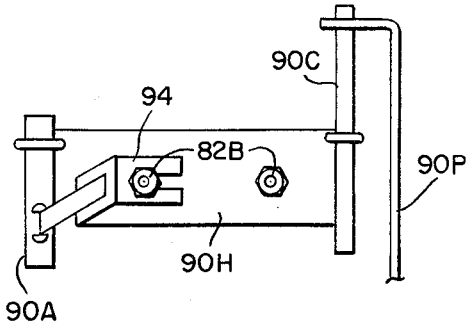
Figure 9:
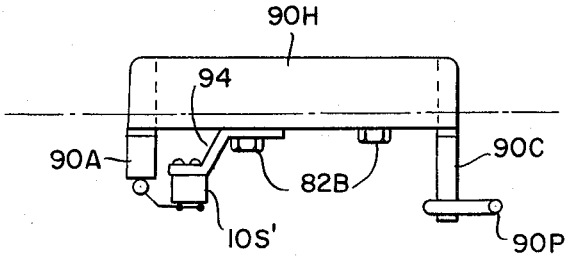

Turning now to FIG. 7, 8 and 9, the mounting of the present code input switch 10S in a conventional type of pull-up car door handle will be discussed. FIG. 7 shows a partial cross-section side view of a car door outside wall 88, pull-up type of handle 90H and associated structure. FIG. 8 shows a back view (i.e., from inside the car) of several of the components of FIG. 7, whereas FIG. 9 shows a top view of the parts shown in FIG. 7.

Pull-up type of car door handle 90H includes an arm 90A which extends inside of the car door 88 and is attached to member 90C. Pulling up on the door handle 90H causes movement of member 90C which in turn causes push rod 90P to actuate a door opening mechanism (not shown). Commonly, such doors include two bolts 82B attached as shown. The switch 10S' may be mounted by attaching bracket 94 with the bolt 82B. The switch 10S' may be a microswitch with a contact on its arm which extends out to the arm 90A of the door handle. When the door handle is pulled up, the microswitch arm moves toward the car door, thereby closing the microswitch contacts.

Method and Operation

Considering now all of the above described figures, but especially the detailed circuit diagram of FIG. 2, the operation and method of the present invention will be discussed in detail. Assuming that an individual returns to his car door and finds that it is locked, the present invention provides a most convenient way of gaining entry to his vehicle. Note initially that the presence of door lock sensing switch 12S (FIG. 5) prevents any power from being delivered to detecting circuit 40 (FIG. 1) when the door is unlocked.

Initially, the car owner will simply depress the push button 80M (FIGS. 4, 5 and 6) or pull up on the door handle 90H (FIGS. 7, 8 and 9). In either case, this initial operation on the door opening actuator (push button 90M or movable handle 90H) will turn on the 555 timer of timing circuit 14. After an initial delay caused by resistor 50R and capacitor 50C, transistor 52 will conduct, in turn causing the relay 54S to close such that chip 7805 of power supply 16 now provides regulated 5 volt power on line 18P to the various circuits of detecting circuit 40. The delay caused by resistor 50R and capacitor 50C is designed to avoid the detecting circuit 40 sensing the initial closure of switch 10S a a code input signal.

Upon power supply 16 supplying regulated 5 volts to the 555 timer of the pulse generator 41, a series of sequential pulses will be output of terminal 3 of that 555 timer. Optionally, these pulses may be used to actuate buzzer and/or light source of LED 42L. This series of pulses are fed into the clocking terminals of the registers 43A, 43B, 43C and 43D.

The resistor 43R and capacitor 43C serve to initialize register 43A at a logical 1 output, whereas the remaining registers are initialized at zero output. Because the registers 43A, 43B, 43C and 43D are connected in a "bucket brigade" type arrangement, the high output of register 43A will be passed from one register to the next. Since the not-Q outputs of these registers are connected to the inputs or corresponding ore gates 44GA, 44GB, 44GC and 44GD, corresponding latches 44FA, 44FB, 44FC and 44FD will sequentially store the switch 10S position (closed or opened) during the first, second, third and fourth respective time intervals of the pulses output by the pulse generator 41.

The code selector 46 will have been preset for a particular code by closing one of the switches 46A and 46A', one of the switches 46B and 46B', one of switches 46C and 46C', and one of the switches 46D and 46D'. Depending upon which of these switches have been closed, the NAND gate 48G1 will receive as its input either the Q or the not-Q outputs of the respective registers 44FA, 44FB, 44FC, and 44FD. As long as the owner closes and opens the switch 10S in a proper time sequence, the unlock signal will be generated on line 18L by the decoder 48. Once the NAND gate 48G1 outputs the appropriate signal, this is fed back into terminal 4 of the 555 astable multivibrator of pulse generator 41, thereby turning off pulse generator 41. The buzzer 42D and/or light 42L are useful in that the owner may more accurately determine the time intervals for depression and/or release of the switch 10S. Alternately, he could simply estimate the time and depress and release during the timed predetermined sequence.

When the unlock signal appears on line 18L, it will be fed to the unlock delay circuit 20. The unlock delay circuit 20 is most advantageous in that it avoids problems which might otherwise occur from attempting to unlock the door while the pushbutton 80M or door handle 90H has not yet returned to its normal (i.e., unmanipulated) position. Since most car doors include a mechanical system such that the door cannot be unlocked when the door opening actuator (pushbutton 80M or handle 90H) is displaced from its normal unmanipulated position, the unlock delay circuit 20 provides sufficient time for the owner to allow the door opening actuator to assume its normal position prior to the actuation of door unlock solenoid 24.

The unlock signal on line 18L is also fed into reset terminal 4 of the 555 timer of the timing circuit 14 by way of the delay circuit including resistor 26R and capacitor 26C. This serves to shut off timer 14 which in turn removes power from the power supply 16, thereby conserving power until the next actuation switch 10s.

If by chance the operator does not input the correct code, the seven second 555 timer of timing circuit 14 will shut itself off after the seven seconds have elapsed.

The use of four registers in the latch memory 44 allows 16 possible combinations. However, this could easily be increased by simply using a greater number of registers in the latch memory 44 and, additionally, using greater than four registers in the pulse sequencer 44, more than four of the OR gates, and a corresponding increase in the switches for code selector 46.

Most advantageously, the present invention does not require an end of sequence pulse in order to unlock the door.

Although the switches 10S and 12S as shown herein are mechanical switches with two contacts which physically open and close, various other switches could be used. Accordingly, as used herein, the term "switch" shall include any structural used to open or close an electric circuit. Among other switches, this would include semiconductor switching devices such as transistors. Further, optical relay switches might be used to sense the movement of a pushrod or other movable part moving under the influence of the door opening actuator. Likewise, an electromagnetic switch or Hall effect device could be used as the switch 10S to detect movement of the door opening pushrod or similar member.

Although the door opening actuator (push button 80M or handle 90H) is moved in its normal opening movement (80M is pushed in, 90H is pulled up) to actuate switch 10S or 10S', the invention in its broadest aspects would include operating the door opening actuator in other manners. For example, the door opening actuator could be operated by moving it other than its normally opening movement. Alternately, it could be operated by having a touch sensitive switch built in to the door opening actuator whereby the door opening actuator is operated by touching it in a predetermined pattern.

Although specific constructions and design details have been disclosed herein, it is to be understood that these details are for illustrative purposes only. Numerous modifications and adaptations will be readily apparent to those of ordinary skill in the art. Accordingly, the scope of the present invention should be determined by reference to the appended claims.

What is claimed is:

1. A method of unlocking a door, the steps comprising:

operating a door opening actuator in a predetermined coded sequence to enter a code, said entered code uniquely and completely determined by operation of said door opening actuator;

detecting said predetermined coded sequence;

generating an electrical unlock signal upon detection of said predetermined coded sequence; and unlocking said door responsive to said electrical unlock signal.

2. The method of claim 1 wherein said predetermined coded sequence of door opening actuator operations causes a corresponding predetermined coded sequence of switch opening/closing operations and said detecting step comprises detecting said predetermined coded sequence of door opening actuator operations by detecting said predetermined coded sequence of switch opening/closing operations.

3. The method of claim 2 wherein said predetermined coded sequence of switch opening/closing operations is a timed predetermined coded sequence of openings and closings of a first switch.

4. The method of claim 3 wherein said door is a car door and said door opening actuator is a door handle.

5. The method of claim 4 wherein said operating step is accomplished by moving at least a portion of said door handle.

6. The method of claim 5 further comprising the step of turning on power to a sequence detecting circuit, which carries out said detecting step, in response to an initial operation of said door opening actuator.

7. The method of claim 5 wherein said detecting of said predetermined coded sequence of switch opening/-closing operations includes:

generating a series of pulses;

repetitively determining whether said first switch is open or closed, each determination corresponding to a pulse in said series of pulses;

storing the results of a plurality of said determinations; and testing said stored results for equality with a predetermined binary code.

8. The method of claim 5 further including the step of turning off power to a sequence detecting circuit, which carries out said detecting step, a preset time after generation of said electrical unlock signal.

9. The method of claim 5 further including the step of delaying the unlocking of said door until sufficiently after generation of said electrical unlock signal such that said door handle will be in a normal position prior to said unlocking.

10. The method of claim 5 further including the steps of:

generating a series of pulses; and outputting a sensory signal responsive to said series of pulses.

11. An apparatus comprising:

(a) a door having a manually operable door opening actuator and a door lock controlled by a door lock actuator;

(b) a detecting circuit for detecting a code uniquely and completely determined by operation of said door opening actuator and for generating an unlock signal upon detection of a predetermined coded sequence of operation of said door opening actuator; and (c) an unlocking circuit for unlocking said door lock responsive to said unlock signal.

12. The apparatus of claim 11 further comprising:

(d) a switch which is open or closed depending upon said door opening actuator; and wherein said detecting circuit detects said predetermined coded sequence of operations of said door opening actuator by detecting a timed predetermined coded sequence of openings and closings of said switch.

13. The apparatus of claim 12 wherein said door is a car door and said door opening actuator is a door handle.

14. The apparatus of claim 13 wherein said operation of said door handle in said predetermined coded sequence comprise normal opening movements of at least a portion of said door handle.

15. The apparatus of claim 14 wherein said door handle includes a push button for opening the door and said normal opening movements are depressions of the push button.

16. The apparatus of claim 15 wherein said push button is connected to a push rod, said switch is a mechanical switch with at last two contacts, and said push rod closes and opens said two contacts of said switch depending upon the position of said push button.

17. The apparatus of claim 14 wherein said normal opening movements of said door handle are pulling movements on said door handle.

18. The apparatus of claim 17 wherein said switch is a mechanical switch with at least two contacts and said two contacts are opened and closed depending upon the position of said door handle.

19. The apparatus of claim 14 wherein said detecting circuit comprises:

a pulse generator for generating a series of pulses; a determinator circuit for repetitively determining whether said switch is open or closed, each determination corresponding to a pulse in said series of pulses; a latch for storing the results of a plurality of said determinations, a code selector for selecting said timed predetermined coded sequence of openings and closings of said switch; and a testing circuit for testing for equality between the timed predetermined coded sequence selected by said code selector and actual sequences of openings and closings of said switch.

20. The apparatus of claim 19 wherein said detecting circuit further comprises a sensory signal generator which outputs a sensory signal responsive to said series of pulses.

21. The apparatus of claim 20 wherein said door lock actuator is a door lock button and said sensory signal generator is a light source disposed adjacent said door lock button and visible by way of a hole housing said door lock button.

22. The apparatus of claim 13 further comprising a delay circuit which delays the unlocking of said door until sufficiently after generation of said unlock signal such that said door handle will be in a normal position prior to unlocking of the door.

23. The apparatus of claim 12 further comprising a power down circuit for turning off power to said detecting circuit after generation of said unlock signal.

24. The apparatus of claim 12 further comprising a power up circuit for turning on power to said detecting circuit upon an initial operation on said door opening actuator.

25. The apparatus of claim 11 further comprising a lock sensing switch and wherein power is not delivered to said detecting circuit if said lock sensing switch senses that said door is unlocked.

26. The method of claim 1 wherein the code is entered using only the normal door opening movement of the door opening actuator.

* * * * *